United States Patent [19]

Schäffeler

[11] 4,081,632

[45] Mar. 28, 1978

[54] CAM OPERATED SWITCH HAVING WAVY SPRING CONTACT ASSEMBLY ABUTTING STOP OR FIXED CONTACT THEREBY STORING KINETIC ENERGY PRIOR TO SUBSEQUENT ENGAGEMENT WITH A FIXED CONTACT ASSEMBLY

[75] Inventor: Alois Schäffeler, Spaichingen, Germany

[73] Assignee: Firma J. & J. Marquardt, Germany

[21] Appl. No.: 626,273

[22] Filed: Oct. 28, 1975

[30] Foreign Application Priority Data

Oct. 26, 1974 Germany ..... 2451034

[51] Int. Cl.[2] ..... H01H 21/80; H01H 1/06

[52] U.S. Cl. ..... 200/6 BB; 200/5 R; 200/6 B; 200/6 C; 200/67 D; 200/68; 200/153 LB; 200/239; 200/275; 200/284

[58] Field of Search ..... 200/1 R, 1 A, 1 B, 5 R, 200/6 R, 6 B, 6 BA, 6 BB, 6 C, 17 R, 153 L, 153 LB, 159 A, 164 R, 237–251, 275, 283, 284, 291, 329, 336, 339, 67 R, 67 D, 67 DA, 67 DB

[56] References Cited

U.S. PATENT DOCUMENTS

| | | | |
|---|---|---|---|
| 2,960,580 | 11/1960 | Aquillon | 200/6 BB |
| 2,962,571 | 11/1960 | Zanichkowsky | 200/159 A |
| 3,371,179 | 2/1968 | Lohr | 200/159 A X |
| 3,373,252 | 3/1968 | Ghaem-Maghami et al. | 200/6 R |
| 3,437,772 | 4/1969 | Piber | 200/284 |
| 3,621,157 | 11/1971 | Schwab | 200/6 BB |
| 3,763,341 | 10/1973 | Willis | 200/6 BB X |
| 3,792,206 | 2/1974 | Purdy | 200/6 B |
| 3,878,344 | 4/1975 | Lockard | 200/6 B |
| 3,883,705 | 5/1975 | Sebastian et al. | 200/6 B |
| 3,900,709 | 8/1975 | Sheesley et al. | 200/6 B X |
| 3,971,904 | 7/1976 | Ward | 200/6 BB |

*Primary Examiner*—James R. Scott
*Attorney, Agent, or Firm*—McGlew and Tuttle

[57] ABSTRACT

An electrical switch comprises a housing with at least one fixed contact thereon and at least one resilient movable contact which has a fixed end secured on said housing and an opposite movable end with a contact portion which is held by the fixed end in a position spaced from the fixed contact. The housing includes a supporting member located between the movable and fixed ends of the movable contact and on the same side as the fixed contact. The movable contact is engageable by actuating means which includes a rotatable cam which first contacts an intermediate wave-shaped portion to cause an inwardly directed portion of the movable contact to move first into engagement with the support member and to subsequently cause the contact portion to move into engagement with the fixed contact.

16 Claims, 4 Drawing Figures

CAM OPERATED SWITCH HAVING WAVY SPRING CONTACT ASSEMBLY ABUTTING STOP OR FIXED CONTACT THEREBY STORING KINETIC ENERGY PRIOR TO SUBSEQUENT ENGAGEMENT WITH A FIXED CONTACT ASSEMBLY

BACKGROUND OF THE INVENTION

1. Field of the Invention

This invention relates in general to the construction of switches and in particular to a switch which includes at least one bendable or swingable movable contact arm which may be anchored at one end in a housing and which has a special configuration of its intermediate portion so that it may be engaged by an actuator to displace the intermediate portion first into engagement with a support or a first fixed contact and then the end portion into engagement with a second fixed contact.

2. Description of the Prior Art

The present invention relates particularly to an electric switch which comprises at least one bendable or swingable contact arm. Switches of this kind are well known in various designs. In the construction of such switches the most important requirements to be met are that the switch have a high contact rating and a long service life and that the construction be low in cost and compact. With a contact arm which is stressed in bending it is necessary that a particularly thin material is used in order to reduce the risk of breaking. The consequence is a small contact pressure which unfavorably influences the electrical capacity of the switch and provides only a very small restoring force. This is very disadvantageous in respect to the service life of the switch.

SUMMARY OF THE INVENTION

The present invention provides a switch having a higher restoring force compared to the known designs in spite of its rugged construction and it may employ a very thin elastically bendable contact arm. The switch includes a housing having a supporting member which is located within the swinging range of an intermediate portion of the resilient contact arm between a fixed and anchored to the housing and an outer free end containing a contact which is engageable with a flat fixed contact in the housing. In a particularly preferred manner, the contact arm intermediate portion comes into contact with a supporting member prior to its closure at the end thereof with the fixed contact. Thus, upon actuation of the switch, the contact arm first swings down in the usual manner until the intermediate portion applies against the support member. Thereupon, the free portion of the contact arm projecting beyond the support member is further swung down until the movable contact comes to apply against the associated fixed contact thereby closing the respective circuit. During this second phase of the swinging motion of the contact arm, the contact arm is elastically deformed and its portion which projects beyond the supporting member so that additional restoring force is accumulated. At the same time the support of the contact arm on the supporting member resultings in a shortening of the operative length of the arm in the final phase of its switching motion and, consequently, in a certain stiffening of the arm. To this effect of course the actuating mechanism must be arranged and designed so as to permit a further motion of the free portion of the contact arm which projects beyond the supporting member or a bending about the supporting point. Preferably the supporting member is designed as a projection of the housing. The additional material costs thereby are therefore negligible.

In accordance with a development of the invention the contact arm is made particularly of a spring material strip and it includes a substantially vertical support portion which is formed with an indentation for stiffening. Due to the elasticity or stiffening of the material of which it is made the contact arm also embodies a return spring so that an additional restoring spring is not required and this lessens the cost of manufacture and assembly. The intermediate portion of the resilient contact arm is formed in an arcuate, V or wave shaped configuration so that an inwardly directed portion of the wave formation forms a stop which engages with the support member.

According to another feature of the invention one branch of the wave shaped formation is joined through a further arcuate intermediate portion to the fixing leg which extends into an anchoring slot of the housing. Thus the contact arm does not have to be mounted on a pivot bearing but is fastened directly to the housing without any further requirement. In the preferred form the intermediate portion includes at least two wave forms or a substantially W-shaped configuration with a first inwardly directed wave formation adjacent the fixed end which extends toward the supporting member and a second wave which extends in an opposite direction which is engageable by an actuating member. The half of the resilient movable contact which is adjacent the outer contact end portion or free end thereof is made of a smaller wave form than the inner end. The contact arm itself may be formed with a contact surface at its outer free end or a separate contact of high quality material may be affixed thereto.

By forming the inner fixed end with a substantially vertical leg portion which is provided with an indentation or crease it may be stiffened and held in a housing slot under tension. The construction makes the device very easy to assembly and provides an inexpensive arrangement both in respect to the cost of the parts and to their assembly. The fixing leg also extends through the slot to the outside of the housing and may be designed as a connection element for the switch.

In accordance with a further feature of the invention the actuation mechanism includes a rotatable cam which has a tooth or projecting part which engages with one of the wave shaped forms of the movable contacts. The direction of rotation is chosen so that upon actuation of the switch the cam moves first against a portion of the switch to move the intermediate part of the switch into engagement with the support member and then to effect a further movement of the outer portion of the switch to cause engagement of the end contact portion with the fixed contact. The construction may be easily adapted to a multiple switch wherein there are a plurality of identical mechanisms in respective chambers of the switch each including a resilient contact which is engageable with a fixed contact and a rotatable cam actuator carried on a single common shaft set to cause the specific sequence of operation during rotation of the shaft. The construction also advantageously includes a notched wheel carried by the shaft which may be indexed during rotation of the shaft by its engagement with a fixed spring in one of the chambers so as to control the positioning of each cam in respect to its associated movable contact in each respective chamber. The notched cam and resilient spring provide a click stop mechanism for indexing the cams of each switch portion so as to provide the desired contact engagement. For example the individual cams and the notches on the notch wheel may be oriented angularly in respect to the center of rotation of the shaft so as to produce a sequential operation of the various movable contacts in each of the compartments. A particularly important advantage from the point of view of manufacture and assembly is obtained if the stop spring is made of one piece in the same manner as the movable contact arms.

In accordance with a further development of the invention a switch which has its contact arms made in one piece also includes a component part comprising the contact arms and the stop spring provided with at least one locking element for establishing an arresting connection with the housing of the switch. This element insures also that the component part is not only clamped in its position but also due to an appropriate locking is better secured against removal. The locking may be designed so that in practice an undetectable union of this component part with the housing of the switch is obtained. Thus the switch is made secure to the highest degree.

Accordingly it is an object of the invention to provide an improved electric switch which includes a housing having at least one fixed contact and at least one resilient movable contact which has a fixed end secured in the housing and an opposite movable end with a contact portion held by the fixed end in a positions paced from the fixed contact and which also includes a support member in the housing located between the movable and fixed ends of the movable contact and on the same side of the movable contact as the fixed contact and with actuating means engageable with the movable resilient contact intermediate its length to move it toward the support member and the fixed contact, the intermediate portion of said movable contact including a portion extending in the direction of the support member and engageable therewith by the movement of the actuator before the contact portion is engageable with the fixed contact.

A further object of the invention is to provide a multiprobe switch which includes a housing having a plurality of compartments each with a movable contact which has one end anchored in the housing and an opposite free end which is movable toward a fixed contact and with actuator means which include the rotatable shaft having an individual cam portion engageable with each movable contact intermediate its length and adapted to move it in a direction toward a support or additional fixed contact in the housing and subsequently to move the free end thereof into engagement with the fixed contact.

A further object of the invention is to provide a switch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

GENERAL DESCRIPTION OF THE PREFERRED EMBODIMENTS

Figure 1:
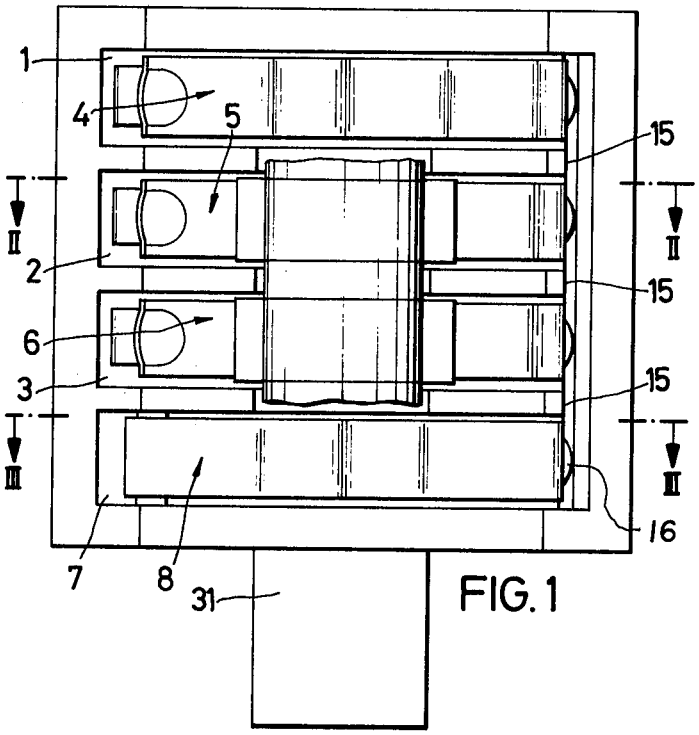
FIG. 1 is a top plan view of a switch with the cover removed and constructed in accordance with the invention.
Figure 2:
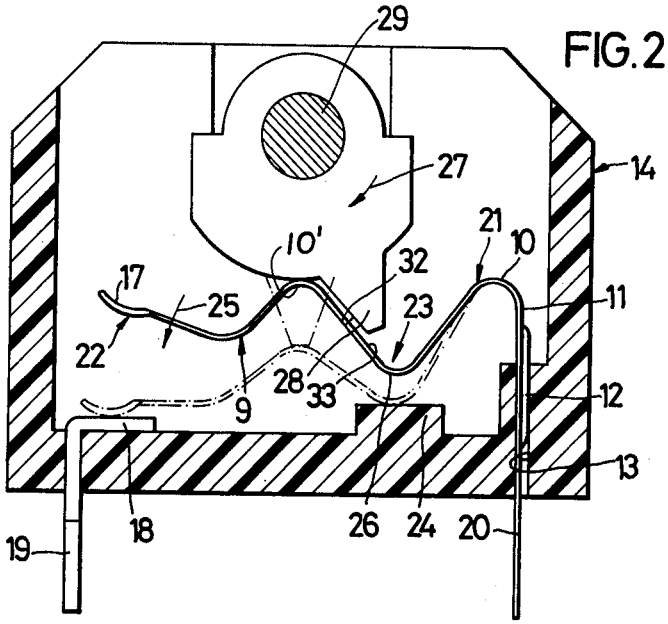
FIG. 2 is a section taken along line II—II of FIG. 1.
Figure 3:
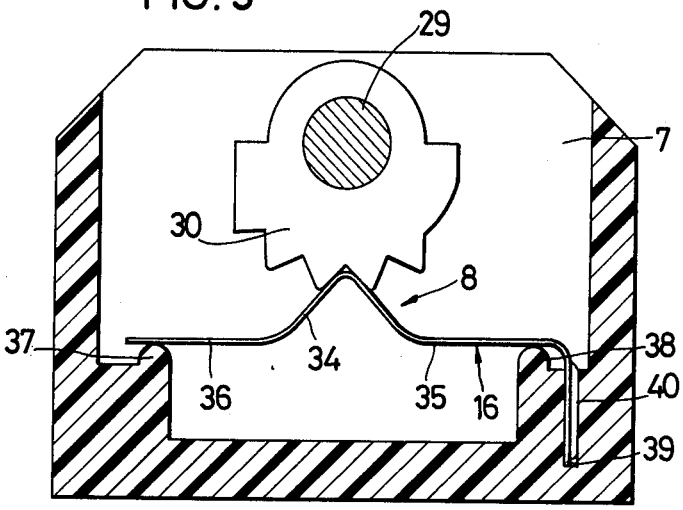
FIG. 3 is a section taken along the line III—III of FIG. 1.

Referring to the drawings in particular the invention embodied therein in FIGS. 1 to 3 comprises a multichamber switch comprising a housing generally designated 14 having a plurality of housing chambers 1, 2 and 3 in which switch mechanism generally designated 4, 5 and 6 are accommodated. The housing also includes a further chamber 7 which is preferably located adjacent one end of the housing in which a click stop mechanism 8 is received for the simultaneous or stepped actuation of the individual switch mechanisms.

The individual switch mechanisms each comprise an electrically well conducting springy contact arm 9. Contact arms 9 form the springs of the switch mechanisms so that separate springs are not necessary.

In accordance with the invention the contact arms 9 comprise movable contacts which have an outer or free end with a movable contact portion 17 and have an inner or fixed end or leg 11 which is engaged in a hole or slot 13 of the housing 14 so that an outer end 20 advantageously projects outwardly therefrom for engagement with an electrical circuit. The contact arm 9 includes an intermediate portion which comprises a wave-shaped or arcuate portion 10 adjacent the leg 11, an inwardly extending wave-shaped portion 26 directed inwardly towards a support member 24 which may also comprise a fixed contact and a second wave-shaped portion 10' having a flank 33 which is engageable by an actuator in the form of a cam 28. These parts or portions are manufactured in a single piece contact arm 9. Fixed leg 11 advantageously includes an indentation or crease extending in the longitudinal direction and serving as means for firmly clamping it in the slot 20 and for reinforcing this portion.

In accordance with a preferred arrangement the spring 9 advantageously includes intermediate portions 15 which interconnect all of the fixing legs 11 of the individual switch contact arms 9 in each of the respective housings 1, 2 and 3. In addition an intermediate portion 15 is also located between the resilient contact arm 9 and a stop spring 16 which as shown in FIG. 3 is connected to the adjacent fixing leg 11. Thus the stop spring 16 and the three contact arms 9 along with their fixing legs 11 form an integral component part. In addition these parts include hooking lugs which are formed integral therewith.

Each movable contact 17 at the free end of the contact arms 9 cooperates with a separate fixed contact 18 which is made integral with an exterior terminal portion 19 for an electrically lead.

Figure 4:
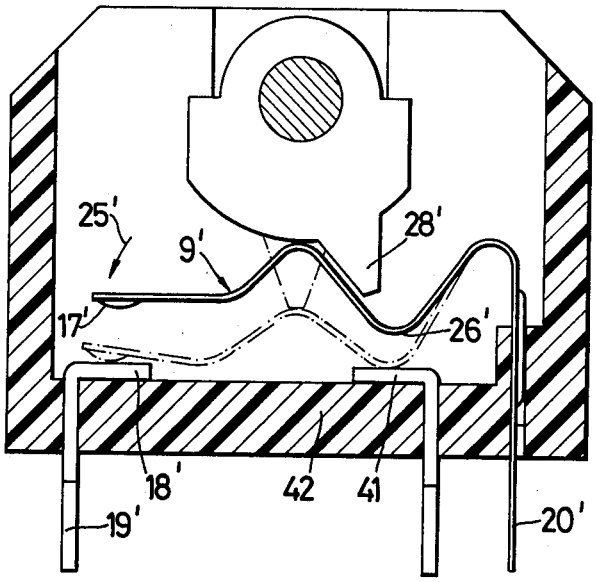
FIG. 4 is a view similar to FIG. 2 of another embodiment of the invention.

In accordance with the invention the housing is provided with a supporting member which is advantageously formed integral with the housing and which may include a separate contact 41 as shown in the embodiment of FIG. 4. The support member 24 is located opposite to the inwardly extending wave-shaped formation portion 23 of the contact arm 9 and between an inner end 21 which contains the fixed leg 11 and the outer free end 22 which contains the movable contact 17. As shown in FIG. 2 the supporting member 24 is designed as a projection of the housing and thus may be molded of plastic along with the housing 14. The contact arm portion 23 which is associated with the supporting member has an approximately V-shaped or U-shaped configuration. The wave-shaped portion of the resilient contact arm 9 exteriorly of the inner wave portion 10' forms a smaller wave form of the substantially W-shaped contact arm 9.

When switching the normally open switch the contact arm 9 is bent downwardly in the direction of the arrow 25 as shown in FIG. 2. The bending point 10' substantially coincides in elevation with the first wave-shaped form 10 adjacent the leg 11. The design is such that the contact arm portion 23 comes into contact with the supporting member 24 before the movable contact 17 reaches the fixed contact 18. This means that in the final phase of the switching motion, the free portion of the contact arm 9 which has an outer curved contact edge 26 is bent down in the direction of 25 whereby the contact arm 9 is loaded in addition and its return motion in the direction opposite to the arrow 25 is strongly supported.

The actuation mechanism for the switch comprises a cam 28 which is affixed to a rotatable shaft 29 and rotates in the direction of the arrow 27. Each housing portion 1, 2 and 3 contains its own separate cam 28 and they are secured against rotation on the shaft 29 or may be made for example in one piece with the shaft. In addition a notched wheel 30 of a click stop mechanism 8 is also secured to the shaft 29 or formed integrally therewith. The laterally projecting end 31 of the shaft 29 extends out of the housing 14 and may be affixed to an actuating member such as a control handle for example. Upon actuation, the flank 32 of the tooth 28 applies against the mating flank 33 of the contact arm portion 23 and the cam 28 engages in the gap between the branches of portion 23.

As shown in FIG. 3 stop spring 16 has the form of a bracket with a central vaulted portion 35 pointed in the direction of a notched wheel 30. The spring includes branches 35 and 36 which are supported on a strip or bead 37 and 38 respectively. The branch 35 is bent at a right angle in order to provide a fixing leg 39 which is engaged in a slot of the housing 14 which also includes an indentation or rib 40 for effecting its securement in the slot and its reinforcement.

In the embodiment shown in FIG. 4 there is a preferred arrangement which may be used for special applications. In such a construction the supporting member is advantageously formed by an additional fixed contact 41. This contact may be designed for example identically with the first fixed contact 18 and have an exterior portion which may be directly connected to an electrical circuit. Other parts are similar to the first embodiment and are similarly designated but with primes. Upon actuation of the switch of the embodiment of FIG. 4 the contact arm 9' is moved in the direction of the arrow 25' and first the V-shaped middle portion 26 applies against the additional fixed contact 41 to close a first circuit. Upon further rotation of the cam 28' the first movable contact 17' finally comes to apply against its fixed contact 18' to close another circuit. The opening of the contacts 17', 18' or 26' takes place in the inverse order. In this construction the additional fixed contact 41 which forms the support member is directly engages the bottom 42 of the housing and no separate support member is needed. The construction is very rugged and is also inexpensive.

While specific embodiments of the invention have been shown and described in detail to illustrate the application of the principles of the invention, it will be understood that the invention may be embodied otherwise without departing from such principles.

What is claimed is:

1. An electric switch comprising a housing, at least one fixed contact in said housing, at least one resilient movable contact in said housing having a fixed end secured on said housing and an opposite movable end with a contact portion held by said movable end in a position spaced from said fixed contact, a supporting member in said housing located between said movable and fixed ends of said movable contact and on the same side of said movable contact as said fixed contact, and actuating means engageable with said movable resilient contact intermediate its length on a portion thereof between said supporting member and said fixed contact to move it towards said support member and said fixed contact, said intermediate portion of said movable contact including a portion extending in the direction of said support member, said support member being located in a position to be engageable with said movable contact intermediate portion by movement of said actuating means in a direction to move said contact portion into engagement with said fixed contact, said support member engaging said intermediate portion before said movable contact is engaged with said fixed contact and said actuating means bearing against said movable contact so as to bias it into engagement with said fixed contact by deflecting it downwardly from said support member.

2. An electric switch according to claim 1, wherein said actuating means comprises a rotatable cam engageable with said movable contact intermediate the length thereof.

3. An electric switch according to claim 1, wherein said support member includes a projecting portion of said housing.

4. An electric switch according to claim 1, wherein said resilient contacts comprise a wave-shaped arm having an intermediate arcuate portion.

5. An electric switch according to claim 4, wherein said movable contact arm includes a fixing leg forming said fixed end and engaged in said housing.

6. An electric switch according to claim 1, wherein said movable contact is substantially W-shaped.

7. An electric switch according to claim 1, wherein said fixed end of said movable contact extends substantially at right angles to the main portion and is provided with a reinforcing indentation and is engaged in said housing.

8. An electric switch according to claim 7, wherein said fixing leg extends through said housing and includes an exterior portion forming a terminal for an electric lead.

9. An electric switch according to claim 1, wherein said actuating means comprises a rotatable shaft, a cam carried on said shaft, said movable contact comprising a wave-shaped arm having a wave portion extending toward said support member, said cam having a flank engageable against said wave portion.

10. An electric switch according to claim 1, including a plurality of switch chambers in said housing each having one fixed contact and one movable contact, said actuating means comprising a rotatable shaft extending through the chambers of said housing and having a cam portion engageable with each of said movable contacts, all of the movable contacts having leg portions engaged in said housing and forming individual terminals for said contacts and having their leg portions interconnected.

11. A switch according to claim 10, wherein said movable contact is of wave-shaped configuration and includes a wave portion extending in the direction of said support member and a second wave portion engageable by said cam means, said movable contact also including a fixed leg engaged in said housing at the fixed end of said movable contact and forming a connecting terminal extending to the exterior of said housing.

12. An electric switch according to claim 10, including a separate click stop mechanism chamber, a stop spring contained in said click stop mechanism chamber, a notched wheel carried by said shaft engageable with said stop spring.

13. A switch according to claim 12, wherein said stop spring comprises a single resilient spring member and being formed of a single piece along with said movable resilient contact.

14. A switch according to claim 1, wherein said actuating means comprises a rotatable shaft having a cam portion engageable with said movable contact, a stop spring contained in said housing, a toothed wheel connected to said shaft and rotatable therewith and engaged with said stop spring, said stop spring indexing said toothed wheel and said shaft during engagement of said actuating means with said movable contact.

15. A switch according to claim 1, including a plurality of individual chambers in said housing each having a fixed contact and a resilient contact and one of said chambers containing said stop spring.

16. An electric switch comprising a housing having a plurality of chambers therein, at least one fixed contact in each of said chambers, at least one resilient movable contact in each of said housing chambers having a fixed end secured on said housing and an opposite movable end with a contact portion held by said fixed end in a postion spaced from said fixed contact, a supporting member in each of said housing chambers located between said movable and said fixed ends of said movable contact and on the same side of said movable contact as said fixed contact, a rotatable shaft mounted in said housing and having a cam portion located in each of said housing chambers engageable with said movable resilient contact intermediate its length, said shaft being rotatable to cause said cam portions to move said movable contact towards said support member and said fixed contact, said intermediate portion of said movable contact including a portion extending in the direction of said support member which is engageable with said support member, said support member being located in a position to be engageable with said movable contact intermediate its length by movement of said cam portion in a direction to move said movable contact portion into engagement with said fixed contact before said movable contact portion is engaged with said fixed contact, said cam bearing against said movable contact so as to bias it into engagement with said fixed contact by deflecting it downwardly from said support member.

* * * * *